US009222674B2

(12) United States Patent
Cunha et al.

(10) Patent No.: US 9,222,674 B2
(45) Date of Patent: Dec. 29, 2015

(54) MULTI-STAGE AMPLIFICATION VORTEX MIXTURE FOR GAS TURBINE ENGINE COMBUSTOR

(75) Inventors: Frank J. Cunha, Avon, CT (US); Torence P. Brogan, Manchester, CT (US)

(73) Assignee: UNITED TECHNOLOGIES CORPORATION, Hartford, CT (US)

( * ) Notice: Subject to any disclaimer, the term of this patent is extended or adjusted under 35 U.S.C. 154(b) by 1131 days.

(21) Appl. No.: 13/188,451

(22) Filed: Jul. 21, 2011

(65) Prior Publication Data

US 2013/0019604 A1 Jan. 24, 2013

(51) Int. Cl.

| | |
|---|---|
| ***F23R 3/26*** | (2006.01) |
| ***F23R 3/06*** | (2006.01) |
| ***F23N 5/16*** | (2006.01) |
| ***F23M 20/00*** | (2014.01) |

(52) U.S. Cl.

CPC ..... *F23R 3/26* (2013.01); *F23M 20/005* (2015.01); *F23N 5/16* (2013.01); *F23R 3/06* (2013.01); *F23D 2900/14482* (2013.01); *F23N 2041/20* (2013.01); *F23R 2900/00013* (2013.01); *F23R 2900/00018* (2013.01); *F23R 2900/03042* (2013.01); *F23R 2900/03044* (2013.01)

(58) Field of Classification Search

CPC .... F23N 5/16; F23R 2900/00013; F23R 3/06; F23R 3/26; F23M 20/005; F23D 2900/14482

USPC ..... 60/752–760, 748, 772

See application file for complete search history.

(56) References Cited

U.S. PATENT DOCUMENTS

| | | | | |
|---|---|---|---|---|
| 3,403,509 | A * | 10/1968 | Eastman et al. | 60/39.281 |
| 3,593,518 | A * | 7/1971 | Gerrard | 60/752 |
| 3,859,786 | A * | 1/1975 | Azelborn et al. | 60/737 |
| 3,872,664 | A * | 3/1975 | Lohmann et al. | 60/746 |
| 3,974,646 | A | 8/1976 | Markowski et al. | |
| 4,012,904 | A * | 3/1977 | Nogle | 60/39.511 |
| 4,192,139 | A * | 3/1980 | Buchheim | 60/739 |
| 4,473,906 | A * | 9/1984 | Warnaka et al. | 381/73.1 |
| 5,265,425 | A * | 11/1993 | Howell | 60/736 |
| 5,285,628 | A * | 2/1994 | Korenberg | 60/775 |
| 5,347,585 | A * | 9/1994 | Taki et al. | 381/71.5 |
| 6,461,144 | B1 * | 10/2002 | Gutmark et al. | 431/2 |
| 6,530,228 | B2 * | 3/2003 | Wilson et al. | 60/776 |
| 6,560,967 | B1 * | 5/2003 | Cohen et al. | 60/776 |
| 6,601,393 | B2 * | 8/2003 | Wilson et al. | 60/776 |
| 6,640,549 | B1 * | 11/2003 | Wilson et al. | 60/776 |
| 6,871,501 | B2 | 3/2005 | Bibler et al. | |
| 7,024,862 | B2 * | 4/2006 | Miyake et al. | 60/773 |
| 2007/0227150 | A1 * | 10/2007 | Alkabie et al. | 60/754 |
| 2010/0132375 | A1 * | 6/2010 | Tanimura et al. | 60/796 |
| 2010/0276225 | A1 * | 11/2010 | Busse et al. | 181/198 |
| 2011/0000219 | A1 | 1/2011 | Myers, Jr. et al. | |

* cited by examiner

*Primary Examiner* — Phutthiwat Wongwian
*Assistant Examiner* — Carlos A Rivera
(74) *Attorney, Agent, or Firm* — Carlson, Gaskey & Olds, P.C.

(57) ABSTRACT

A multi-stage vortex mixer for a combustor of a gas turbine engine includes a vortex amplifier stage in communication with a first stage amplifier, the vortex amplifier stage in communication with a dilution hole.

20 Claims, 7 Drawing Sheets

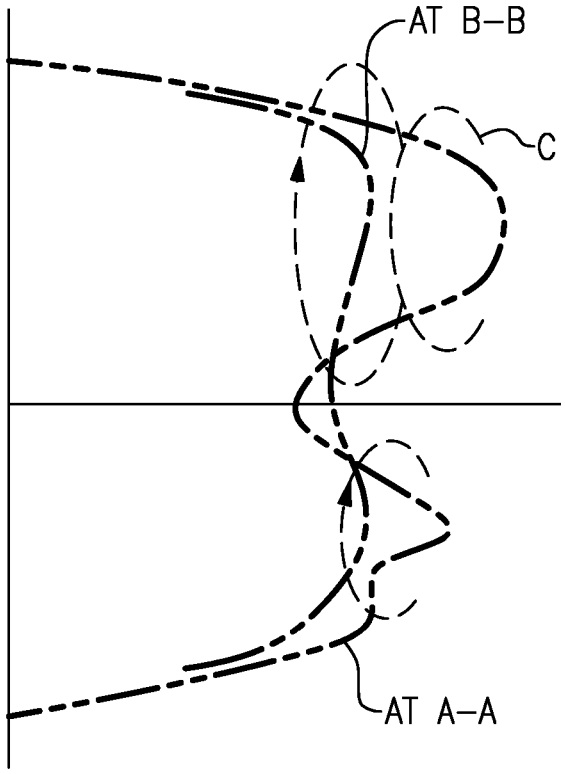
FIG.9
FIG.10
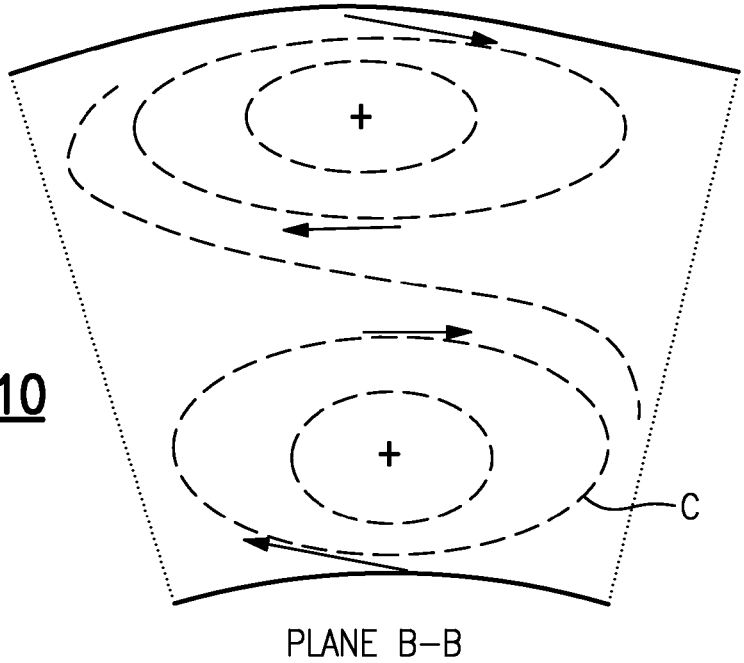

MULTI-STAGE AMPLIFICATION VORTEX MIXTURE FOR GAS TURBINE ENGINE COMBUSTOR

BACKGROUND

The present disclosure relates to a combustor, and more particularly to a combustor with a cooling air mixture that reduces peaks in exit gas temperatures and reduces emissions simultaneously.

As gas turbine engine design requirements increase for improved thrust specific fuel consumption (TSFC), compressor discharge conditions of pressure and temperature along with combustor exit temperatures (CET) may increase. As a result, current combustor configuration emissions, such as NOx, CO, unburned HC, and smoke, may increase. Emissions such as smoke are derived from fuel rich regions with high temperature gradients as unburned carbon. CO is an intermediate product of HC combustion, formed in rich flames with insufficient oxygen or in lean flames due to excessive quenching. NOx emissions can be classified in three categories: (1) thermal NOx associated with increases in flame temperature, proportional to the residence time in the combustor; (2) fuel NOx associated with conversion of fuel bound nitrogen in the fuel; and (3) prompt NOx associated with interactions of transient chemical species (typically HC) in the flame front with surrounding nitrogen. These emissions are related to flame temperature profiles, and to flame stability. As such, reduction of residence time after one or more stages of combustion may minimize thermal NOx, and reduce exit gas temperature distributions.

SUMMARY

A multi-stage vortex mixer for a combustor of a turbine engine according to an exemplary aspect of the present disclosure includes a first stage first control passage, a first stage second control passage and a feed passage in communication with a first stage amplifier; and a vortex amplifier stage in communication with the first stage amplifier, the vortex amplifier stage in communication with a dilution hole.

A combustor of a turbine engine according to an exemplary aspect of the present disclosure includes a first multi-stage vortex mixer downstream of a first fuel injector and a second multi-stage vortex mixer downstream of the first fuel injector.

A method of cooling a combustor of a turbine engine according to an exemplary aspect of the present disclosure includes controlling a swirl of a dilution jet in response to a combustor chamber pressure wave.

BRIEF DESCRIPTION OF THE DRAWINGS

Various features will become apparent to those skilled in the art from the following detailed description of the disclosed non-limiting embodiment. The drawings that accompany the detailed description can be briefly described as follows:

FIG. 9 is a normalized plot of gas temperature to compare gas temperatures at plane A-A and B-B in FIG. 7; and FIG. 10 is a plan view at section B-B of the secondary air swirl flow as generated by the multi-stage mixer.

DETAILED DESCRIPTION

Figure 1:
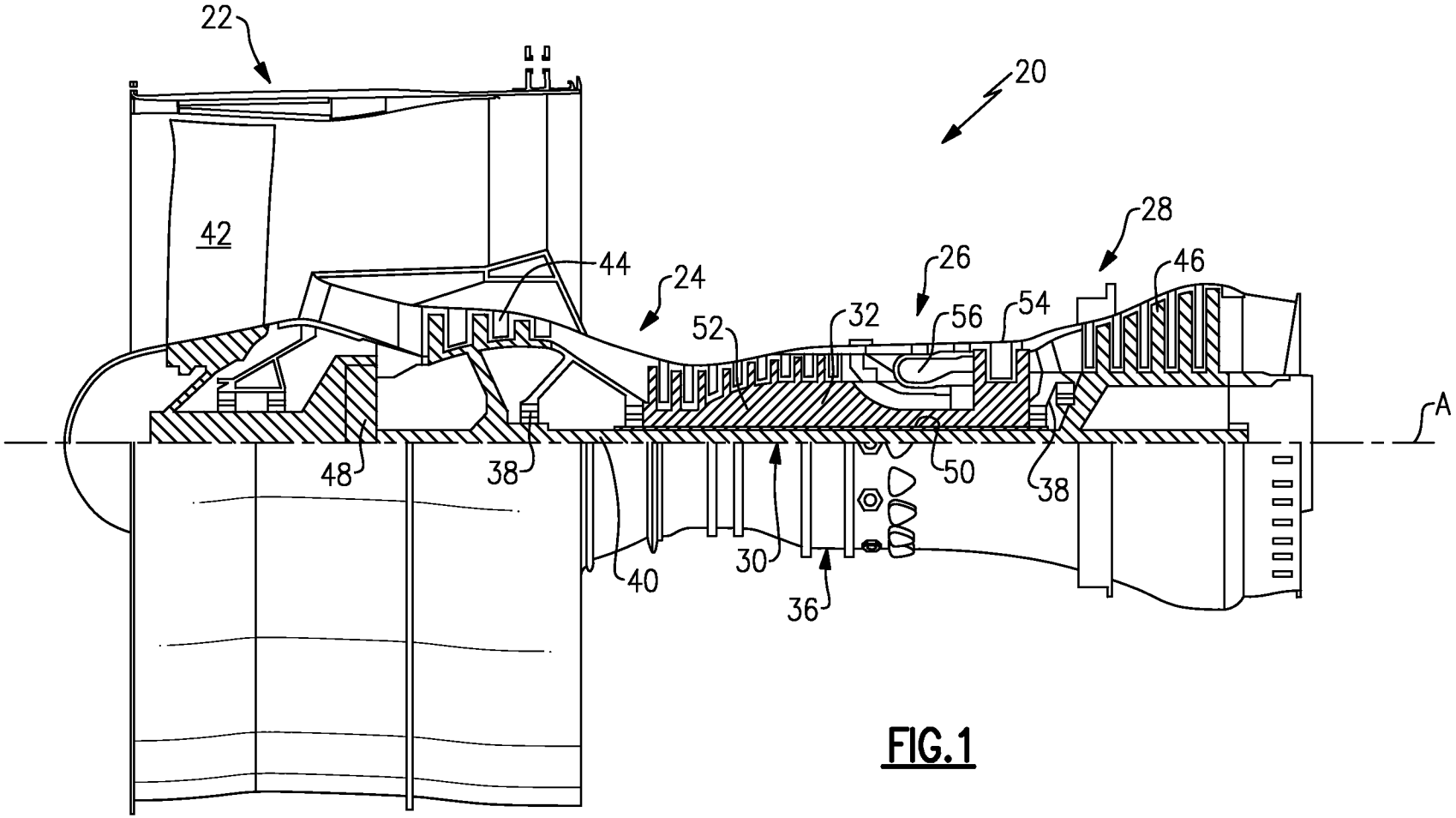
FIG. 1 is a schematic cross-section of a gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include an augmentor section (not shown) among other systems or features. The fan section 22 drives air along a bypass flowpath while the compressor section 24 drives air along a core flowpath for compression and communication into the combustor section 26 then expansion through the turbine section 28. Although depicted as a turbofan gas turbine engine in the disclosed non-limiting embodiment, it should be understood that the concepts described herein are not limited to use with turbofans as the teachings may be applied to other types of turbine engines.

The engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided.

The low speed spool 30 generally includes an inner shaft 40 that interconnects a fan 42, a low pressure compressor 44 and a low pressure turbine 46. The inner shaft 40 is connected to the fan 42 through a geared architecture 48 to drive the fan 42 at a lower speed than the low speed spool 30. The high speed spool 32 includes an outer shaft 50 that interconnects a high pressure compressor 52 and high pressure turbine 54. A combustor 56 is arranged between the high pressure compressor 52 and the high pressure turbine 54. The inner shaft 40 and the outer shaft 50 are concentric and rotate about the engine central longitudinal axis A which is collinear with their longitudinal axes.

The core airflow is compressed by the low pressure compressor 44 then the high pressure compressor 52, mixed and burned with fuel within the combustor 56, then expanded over the high pressure turbine 54 and low pressure turbine 46. The turbines 54, 46 rotationally drive the respective low speed spool 30 and high speed spool 32 in response to the expansion.

Figure 2:
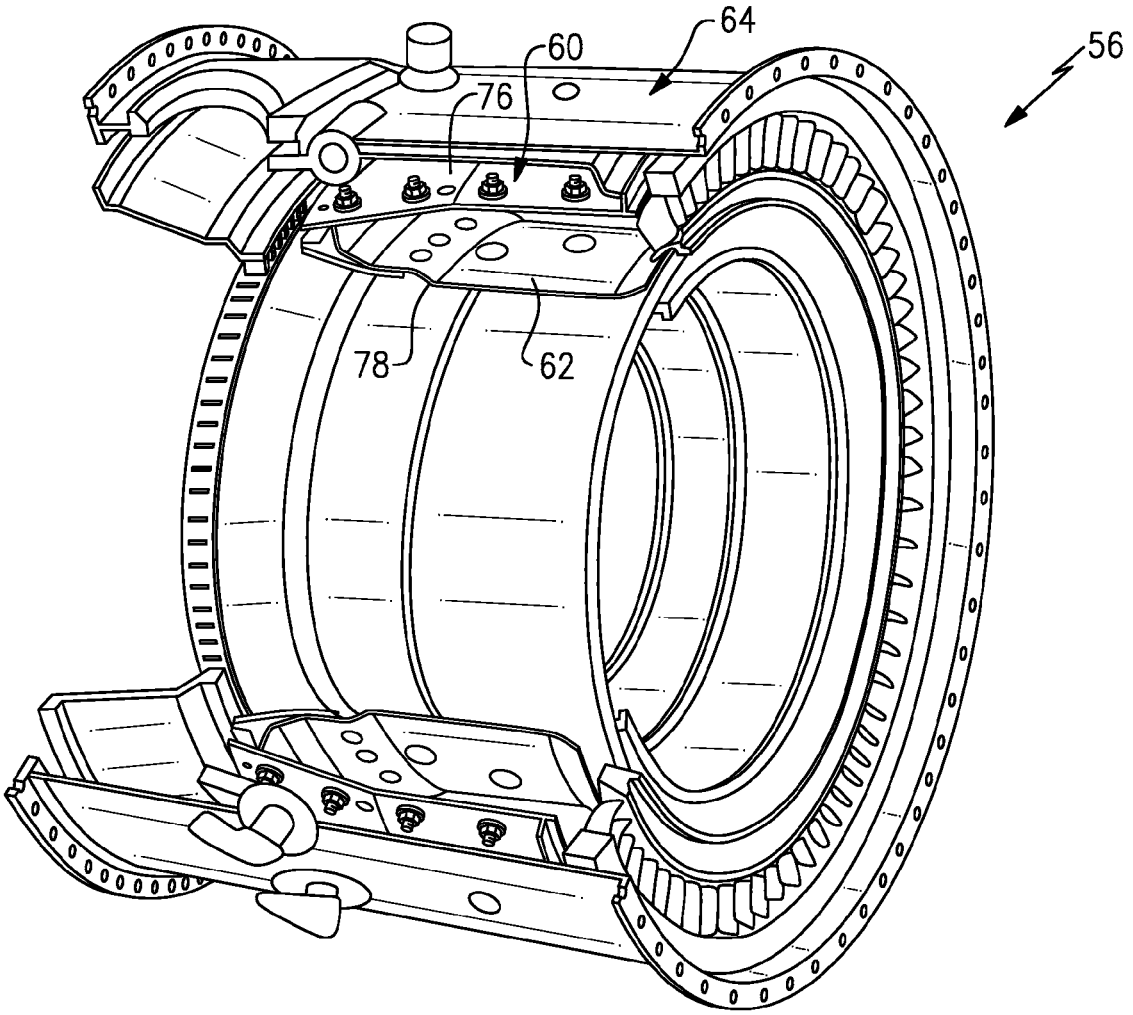
FIG. 2 is a perspective partial sectional view of an exemplary annular combustor that may be used with the gas turbine engine shown in FIG. 1.

With reference to FIG. 2, the combustor 56 generally includes an outer combustor liner 60 and an inner combustor liner 62. The outer combustor liner 60 and inner combustor liner 62 are spaced inward from a combustor case 64 such that a combustion chamber 66 is defined between combustor liners 60, 62. The combustion chamber 66 is generally annular in shape and is defined between combustor liners 60, 62.

The outer combustor liner 60 and the combustor case 64 define an outer annular passageway 76 and the inner combustor liner 62 and the combustor case 64 define an inner annular passageway 78. It should be understood that although a particular combustor is illustrated, other combustor types with various combustor liner panel arrangements will also benefit herefrom. It should be further understood that the disclosed cooling flow paths are but an illustrated embodiment and should not be limited only thereto.

Figure 3:
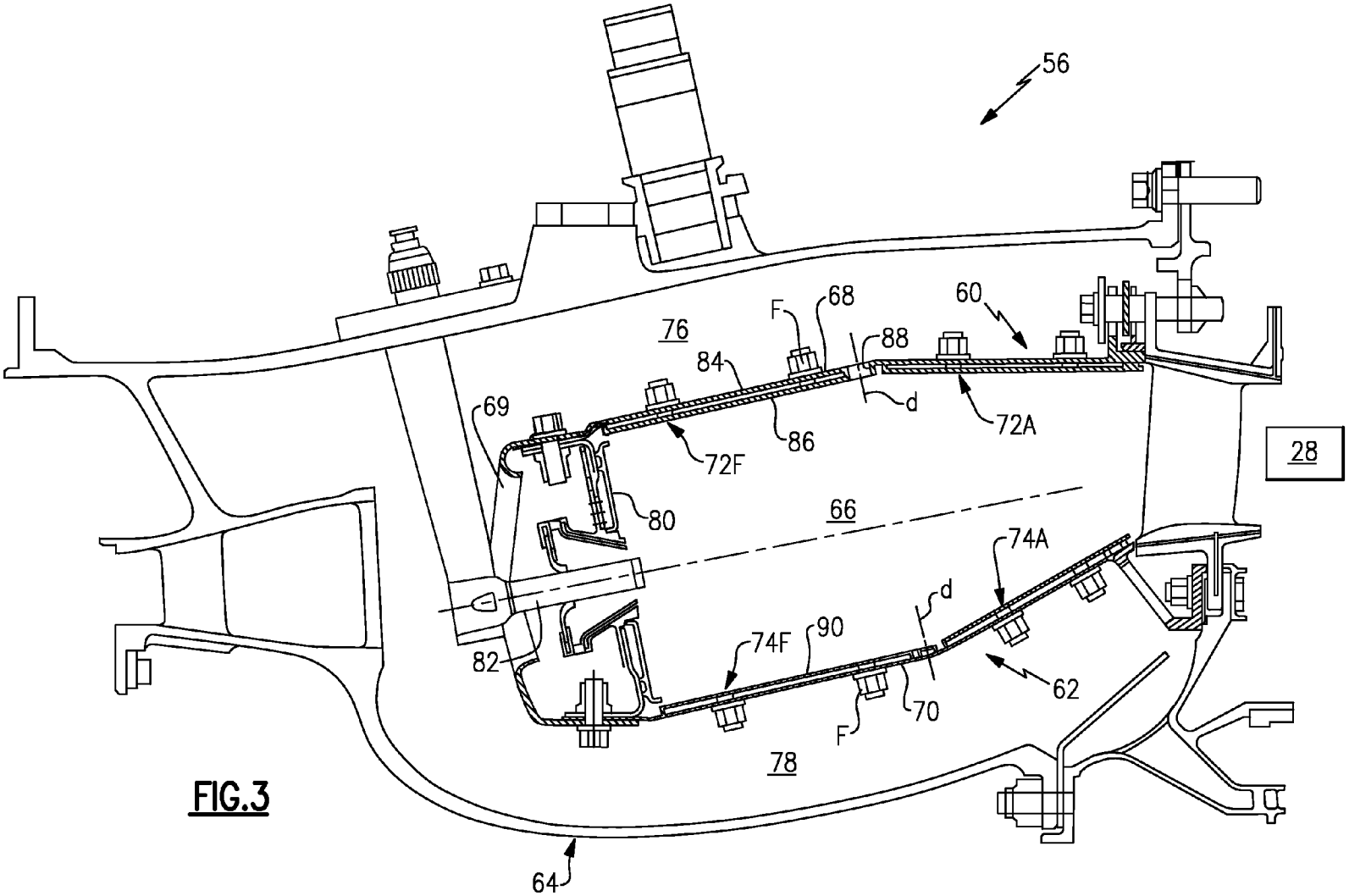
FIG. 3 is a cross-sectional view of an exemplary combustor that may be used with the gas turbine engine.

With reference to FIG. 3, the combustor liners 60, 62 contain the flame for direction toward the turbine section 28. Each combustor liner 60, 62 generally include a shell 68, 70 which supports one or more liner panels 72, 74 mounted to a hot side of the respective shell 68, 70. The liner panels 72, 74 define a liner panel array which may be generally annular in shape. Each of the liner panels 72, 74 may be generally rectilinear and manufactured of, for example, a nickel based super alloy or ceramic material.

In the disclosed non-limiting embodiment, the liner panel array includes forward liner panels 72F and aft liner panels 72A that line the hot side of the outer shell 68 with forward liner panels 74F and aft liner panels 74A that line the hot side of the inner shell 70. Fastener assemblies F such as studs and nuts may be used to connect each of the liner panels 72, 74 to the respective inner and outer shells 68, 70 to provide a floatwall type array. It should be understood that various numbers, types, and array arrangements of liner panels may alternatively or additionally be provided.

The liner panel array may also include liner bulkhead panels 80 that are radially arranged and generally transverse to the liner panels 72, 74. Each of the bulkhead panels 80 surround a fuel injector 82 which is mounted within a forward assembly 69 which connects the respective inner and outer support shells 68, 70. The forward assembly 69 receives compressed airflow from the compressor section 24 to introduce primary core combustion air into the forward section of the combustion chamber 66, the remainder of which enters the plenums 76, 78. The multiple of fuel injectors 82 and the forward assembly 69 generate a swirling, intimately blended fuel-air mixture that supports combustion in the forward section of the combustion chamber 66.

Figure 4:
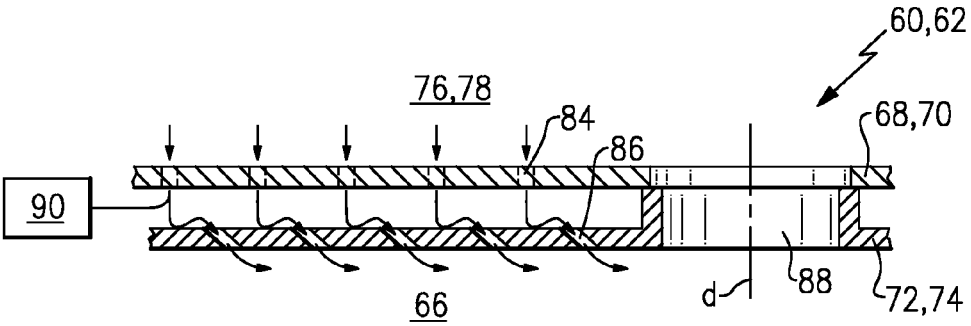
FIG. 4 is an exploded sectional view of a section of combustor liner.

A cooling arrangement disclosed herein may generally include a multiple of impingement cooling holes 84 and film cooling holes 86. The impingement cooling holes 84 penetrate through the inner and outer shells 68, 70 to communicate coolant, such as secondary cooling air, into the space between the inner and outer support shells 68, 70 and the respective liner panels 72, 74 to provide backside cooling thereof (FIG. 4). The film cooling holes 86 penetrate each of the liner panels 72, 74 to promote the formation of a film of cooling air for effusion cooling.

A multiple of dilution holes 88 penetrates both the inner and outer support shells 68, 70 and the respective liner panels 72, 74 along a common dilution hole axis d to inject dilution air as a dilution jet which facilitates combustion and release additional energy from the fuel. The dilution holes 88 may also be described as quench jet holes; combustion holes; and combustion air holes.

Relatively strong dilution jets decrease residence time with further NOx reduction. From the data acquired to-date for engine testing, demonstration and certification requirements, the stability for primary zone combustion followed by (close to) stoichiometric combustion are directly related to the mixing characteristics of fuel-air injectors; aerodynamic contouring of the combustion chamber; and the dilution jet characteristics in terms of position, orientation and strength.

Figure 5:
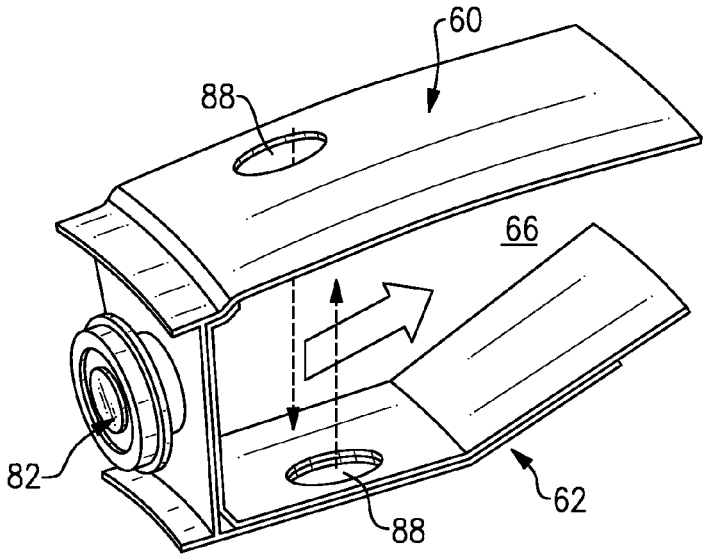
FIG. 5 is a partial perspective view of one circumferential segment of the exemplary combustor of FIG. 3 as associated with one fuel injector.

In the disclosed non-limiting embodiment, the cooling/mixing jet hole pattern design may includes a counter-swirl dilution hole 88 arrangement (one combustion section shown in FIG. 5). The counter-swirl arrangement may be arranged in such a way as to oppose the upstream swirling injector flows. The dilution hole size permits further jet penetration across the radial-circumferential plane in the combustor. This counter-swirl effect is also enhanced by position of the dilution air close to the primary mixing zone, resulting in uniform combustor exit temperature (CET) distribution.

Figure 6:
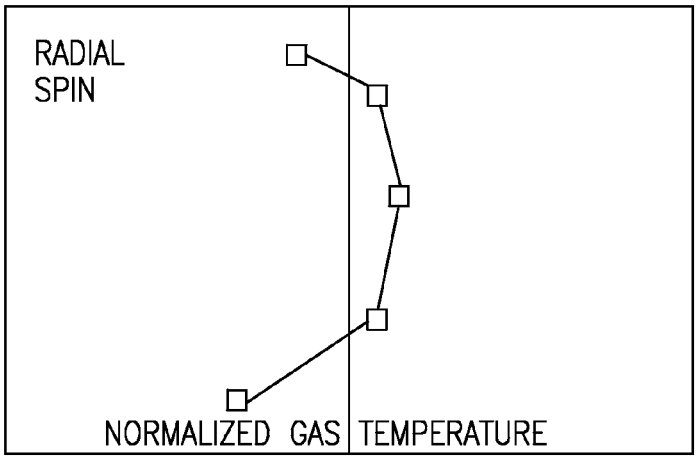
FIG. 6 is a normalized gas temperature plot of a flow sheet within the exemplary combustor.

The increased strength of the individual dilution jets for the counter-swirl design is shown by a combustion-flow-sheet defined between the dilution jets (FIG. 6). Notably, the relatively flat profile represents a relatively equal gas temperature. This is a consequence of initial quasi-one-dimensional momentum associated with each dilution jet prior to the counter-swirl effect of the two jets combined. As the dilution jet is forced to deeper penetration (immersion) in the combustion chamber 66, the starting jet momentum is almost one-dimensional, and normal to the combustor liners 60, 62. The interpretation of the gas stream sheet dynamics may be attributed to a series of impulse functions usually attributed to chemically reactive flows in the combustion chamber 66. In certain instances, however, even more Gaussian like peaks are able to penetrate the dilution jet plane, particularly if the jets are located close to the primary mixing zone. Thus, it is desirable to circumvent this jet propensity by modifying the dilution jet characteristics.

Figure 7:
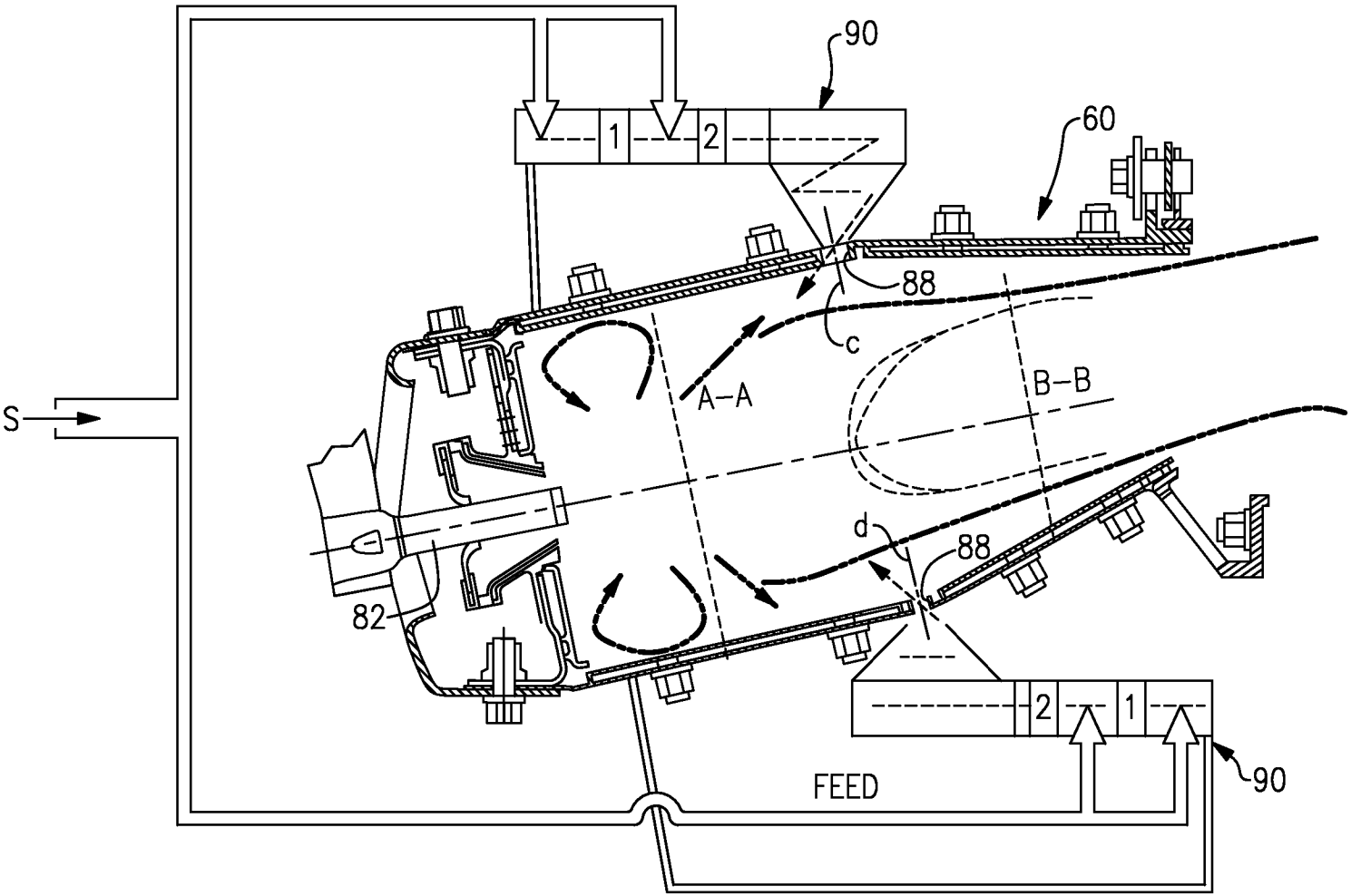
FIG. 7 is an expanded cross-sectional view of a combustor with a multi-stage vortex mixer.

With reference to FIG. 7, a multi-stage vortex mixer 90 is in communication with each dilution hole 88. The multi-stage vortex mixer 90 improves the mixing characteristics of the dilution jets with coherent swirling flows throughout the mixing plane. The multi-stage vortex mixer 90 may be selectively formed through a refractory metal core process. Refractory metal cores (RMCs) are typically metal-based casting cores usually composed of molybdenum with a protective coating. The refractory metal provides more ductility than conventional ceramic core materials while the coating—usually ceramic—protects the refractory metal from oxidation during a shell fire step of the investment casting process and prevents dissolution of the core from molten metal. The refractory metal core process allows small features to be cast inside internal passages.

Although illustrated schematically external to the liners 60, 62, the multi-stage vortex mixer 90 may be formed within the combustor liner 60, 62 through an RMC process (FIG. 4). In particular, two multi-stage vortex mixers 90 may be associated with each fuel injector 82. It should also be understood that various positions and orientations may be provided for the multi-stage vortex mixer 90.

Figure 8:
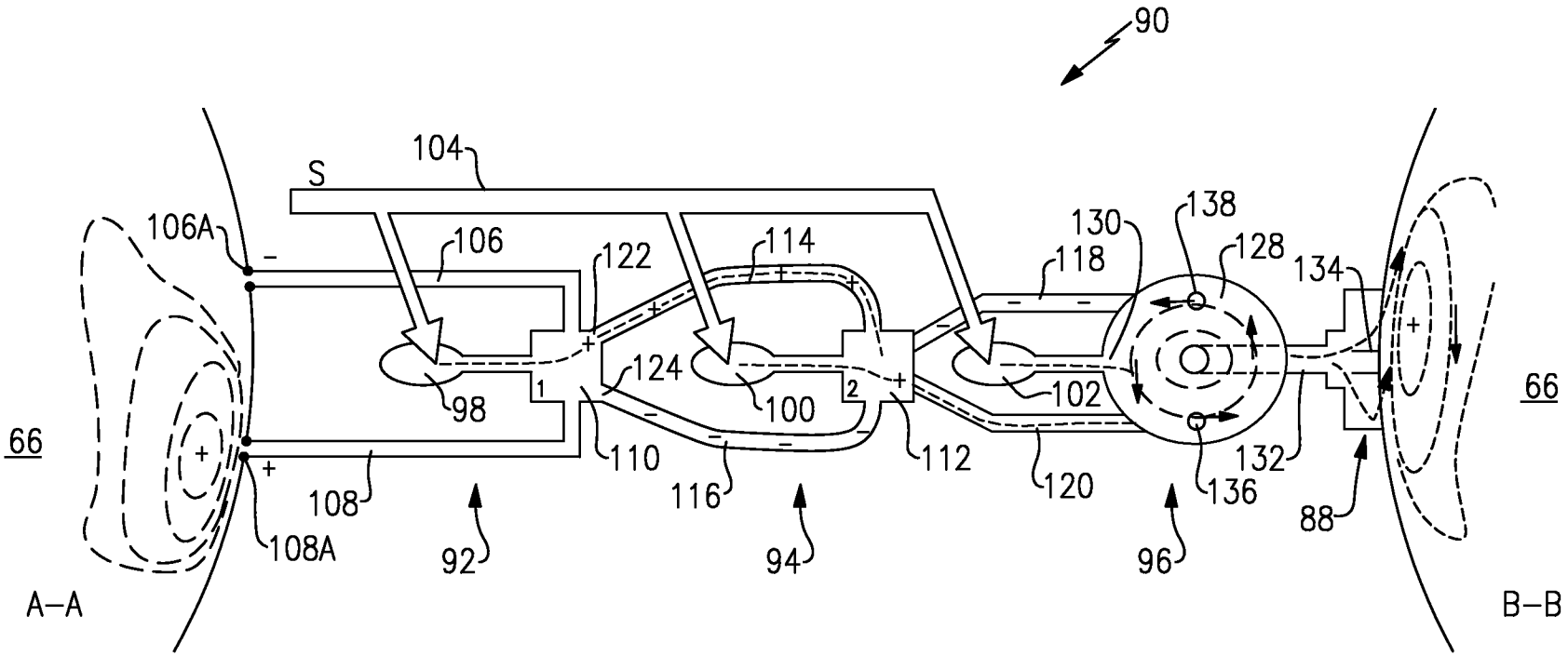
FIG. 8 is a schematic view of the multi-stage vortex mixer.

With reference to FIG. 8, the multi-stage vortex mixer 90 generally includes a first stage 92, a second stage 94 and a vortex amplifier stage 96. It should be understood that any number of stages may alternatively or additionally be provided such as elimination of the second stage. Each of the first stage 92, the second stage 94 and the vortex amplifier 96 include a respective main jet feed chamber 98, 100, 102 which receive a secondary cooling air S from a feed passage 104. In the disclosed non-limiting embodiment, the feed passage 104 may be the secondary cooling air S discharge from, for example, combustor liner cooling such as from the impingement cooler holes 84 so that as pressure is consumed in the combustor liner cooling flow circuitry, the secondary cooling air S discharge may be amplified and subsequently directed into the combustion chamber 66 (FIG. 4).

Each multi-stage vortex mixer 90 includes a first stage first control passage 106 and a first stage second control passage 108 in communication with a first stage amplifier 110. The first stage amplifier 110 is downstream of the first stage feed chamber 98. The first stage amplifier 110 is in communication with a second stage amplifier 112 through a second stage first control passage 114 and a second stage second control passage 116. The second stage amplifier 112 is in communication with the vortex amplifier 96 through a vortex amplifier stage first control passage 118 and a vortex amplifier stage second control passage 120.

The first stage first control passage 106 and the first stage second control passage 108 originate at predetermined axial pick-up points 106A, 108A in communication with the combustion chamber 66 (cross-sectional plane A-A; FIG. 7). In the disclosed non-limiting embodiment, the pick-up points 106A, 108A may be apertures protected by, for example, upstream wall film cooling to maintain suitable temperatures in the first stage first control passage 106 and the first stage second control passage 108 yet still detect pressure pulses from the main flow dynamics within the combustion chamber 66 at cross-sectional plane A-A; FIG. 7).

The pick-up points 106A, 108A are located at the same axial position (cross-sectional plane A-A) but are circumferentially displaced within the combustion chamber 66 so as to register the circumferential pressure difference between the two pick-up points 106A, 108A. The pressure signals are transmitted to the first stage amplifier 110. In first stage amplifier 110, the main jet flow is introduced from the main jet feed chamber 98. The main jet flow is distributed between two first stage outlet passages 122, 124 according to the balance of the control jets from the first stage first control passage 106 and the first stage second control passage 108 which provide the differential pressure, if any, between the pick-up points 106A, 108A. The output of the first stage amplifier 110 is the differential pressure which operates to direct the main jet flow.

In the disclosed non-limiting embodiment, a second stage amplifier 112 is introduced so that the output from the first stage amplifier 110 may be cascaded to amplify the multi-stage vortex mixer 90 gain. In this case, for the two stages 92, 94, the gains are multiplied. This is particularly significant as the pressure supply for combustor cooling is relative low and is considered parasitic to the engine cycle. In this way, the multi-stage vortex mixer 90 facilitates amplification thereof.

The multi-stage vortex mixer 90 cascades finally towards the vortex amplifier 96 which includes a cylindrical vortex chamber 128, a main supply jet port 130 from the main jet feed chamber 102, and an outlet port 132 connected to a receiver tube 134 in communication with the combustion chamber 66 through the dilution hole 88. The main power supply jet to the vortex amplifier stage 96 is admitted through the main supply jet port 130. The vortex amplifier stage first and second control passages 118, 120 feed tangential ports 136, 138 in the cylindrical vortex chamber 128 to mix with the main power supply jet from the main supply jet port 130 so as to selectively generate a vortex.

The output flow rate from the vortex amplifier 96 is generated by the area of the outlet port 132 and the control jets from the vortex amplifier stage first and second control passages 118, 120. If the main supply jet port 130 area is larger than the outlet port 132, without imbalance from the control jets generated by tangential ports 136, 138 of the vortex amplifier stage first and second control passages 118, 120, the pressure in the vortex chamber 128 is constant and equal to the supply pressure.

When no control jets are present from the vortex amplifier stage first and second control passages 118, 120 there is steady state uniform jet that leaves the outlet port 132 and enters the receiver tube 134 for communication into the combustion chamber 66 at plane B-B as a dilution jet, i.e., a so-called one-dimensional momentum jet. It should be noted that this situation would indeed occur if the pressure signals from the pick-up points 106A, 108A in the combustion chamber 66 were generally equivalent, showing no preferential imbalance.

When control jets from the vortex amplifier stage first and second control passages 118, 120 are admitted, these tangentially directed control jets mix with the main power supply jet from the main supply jet port 130 and generates a vortex in response to the imbalance of the combustion chamber 66 at plane A-A amplified by the gain of the first amplifier stage 92 and the optional second amplifier stage 94. Because of the conservation of angular momentum, and as the vortex chamber 128 radius decreases, tangential velocity increases:

$$dp/dr = \text{density}(V^2/r)$$

where

V=tangential velocity;

r=radius;

p=pressure.

Because of the radial pressure gradient of the vortex within the vortex amplifier 96, the outlet flow rate is decreased as the vortex is made stronger. As the vortex flow is made stronger, most of the flow fans out the dilution hole 88 and relatively little flows through the central discharge tube 134 to thereby generate stronger vortex mixing inside the combustion chamber 66.

The net effect of the multi-stage vortex mixer 90 is shown schematically in FIG. 9 where the vortex penetration in the combustion chamber 66 encircles the main stream core combustion gas flow C from the fuel injector 82/forward assembly 69, mixing hot-to-cold regions and vice-versa in a manner that responds to the pressure waves at the circumferential pick-up points 106A, 108A from the dynamics within the combustion chamber 66. The multi-stage vortex mixer 90 thereby provides a selective vortex swirl (FIG. 10) in the combustion chamber 66 to enhance mixing, provide rapid quenching, and optimize CET distribution. This is readily achieved by the multi-stage vortex mixer 90 without moving parts.

The stronger the pressure imbalance at the pick-up points 106A, 106B (plane A-A) the stronger the vortex mixing inside the combustion chamber 66 (cross-sectional plane B-B). If there is no imbalance at the pick-up points 106A, 108A, the vortex ceases to exist and the multi-stage vortex mixer 90 functions in a manner of a conventional dilution jet without swirl.

The multi-stage vortex mixer 90 is operable to sense combustor chamber pressure waves from combustion dynamics and provide feedback; tailors a cooling mixture with sufficient swirl proportional to the combustor chamber pressure waves; generates different stages of pressure amplification to optimize mixing in the combustor chamber; increases vortex mixing amplification external to the combustion chamber; minimize areas of relatively low swirl in the mixing plane of the combustor chamber; integrates the cooling feed lines with combustor liner cooling lines by "re-using" secondary cooling air flow; decreases the overall length of the combustor chamber as a result of improved mixing; control gas temperature in the combustor; minimize residence time with high amplification swirl mixing; minimizes the local fuel rich zone to control smoke; and positions the mixing plane so as to maintain sufficient temperatures at low power without moving parts for high reliability.

It should be understood that relative positional terms such as "forward," "aft," "upper," "lower," "above," "below," and the like are with reference to the normal operational attitude of the vehicle and should not be considered otherwise limiting.

It should be understood that like reference numerals identify corresponding or similar elements throughout the several drawings. It should also be understood that although a particular component arrangement is disclosed in the illustrated embodiment, other arrangements will benefit herefrom.

Although particular step sequences are shown, described, and claimed, it should be understood that steps may be performed in any order, separated or combined unless otherwise indicated and will still benefit from the present disclosure.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be understood that within the scope of the appended claims, the disclosure may be practiced other than as specifically described. For that reason the appended claims should be studied to determine true scope and content.

What is claimed is:

1. A multi-stage vortex mixer for a combustor of a turbine engine comprising:

a first stage differential pressure amplifier for a combustion chamber;

a first stage first control passage in communication with said first stage differential pressure amplifier;

a first stage second control passage in communication with said first stage differential pressure amplifier, wherein said first stage first control passage and said first stage second control passage originate at first and second pick-up points in communication with said combustor chamber;

a first stage first outlet passage in communication with said first stage differential pressure amplifier;

a first stage second outlet passage in communication with said first stage differential pressure amplifier;

a feed passage in communication with said first stage differential pressure amplifier, wherein said first stage differential pressure amplifier is configured to distribute flow from the feed passage to said first stage first and second outlet passages according to a differential pressure between said first and second pick-up points; and a vortex amplifier in communication with said first stage amplifier, said vortex amplifier configured for communication with said combustor chamber through a dilution hole.

2. The multi-stage vortex mixer as recited in claim 1, wherein said pick-up points are circumferentially displaced.

3. The multi-stage vortex mixer as recited in claim 1, wherein said first stage differential pressure amplifier is in communication with said vortex amplifier through a vortex amplifier first control passage and a vortex amplifier stage second control passage.

4. The multi-stage vortex mixer as recited in claim 3, wherein said feed passage is in communication with said vortex amplifier through a vortex stage jet feed chamber.

5. The multi-stage vortex mixer as recited in claim 1, wherein said vortex amplifier is in communication with said first stage differential pressure amplifier through a second differential pressure stage amplifier.

6. The multi-stage vortex mixer as recited in claim 5, wherein said second stage differential pressure amplifier is in communication with said vortex amplifier through a vortex amplifier stage first control passage and a vortex amplifier stage second control passage.

7. The multi-stage vortex mixer as recited in claim 1, wherein said feed passage comprises cooling air from impingement holes in a liner of said combustor; and said first stage differential pressure amplifier and said vortex amplifier are configured to amplify said cooling air and subsequently direct said cooling air into said combustion chamber.

8. The multi-stage vortex mixer as recited in claim 3, wherein said vortex amplifier comprises:

a main supply jet port for communication with said feed passage;

a cylindrical vortex chamber configured to mix fluid from said vortex amplifier first control passage and said vortex amplifier stage second control passage with fluid from said main supply jet port to selectively generate a vortex;

a receiver tube in communication with said combustion chamber through said dilution hole; and an outlet port in connection with said receiver tube.

9. The multi-stage vortex mixer as recited in claim 1, wherein said multi-stage vortex mixer is configured to be external to said combustor.

10. The multi-stage vortex mixer as recited in claim 1, wherein said first stage differential pressure amplifier is configured to receive pressure signals from said first and second pick-up points.

11. A combustor of a turbine engine comprising:

a combustion chamber;

a first fuel injector;

a first multi-stage vortex mixer including a first-stage amplifier in direct communication with said combustor chamber at first multi-stage vortex mixer first and second pick-up points via first multistage vortex mixer first and second passages, said first-stage vortex mixer first and second passages extending from said first multi-stage mixer first and second pick-up points, respectively, to said first-stage amplifier, said first multi-stage vortex mixer further comprising a first vortex amplifier, wherein said first multi-stage vortex mixer is downstream of said first fuel injector; and a second multi-stage vortex mixer including a second-stage amplifier in direct communication with said combustor chamber at second multi-stage vortex mixer first and second pick-up points via second multi-stage vortex mixer first and second passages, said second multi-stage vortex mixer first and second passages extending from said second multi-stage vortex mixer first and second pick-up points, respectively, to said second-stage amplifier, said second multi-stage vortex mixer further comprising a second vortex amplifier, wherein said second multi-stage vortex mixer is downstream of said first fuel injector.

12. The combustor as recited in claim 11, wherein said first multi-stage vortex mixer is defined within an outer liner and said second multi-stage vortex mixer is defined within an inner liner assembly.

13. The combustor as recited in claim 11, wherein said first multi-stage vortex mixer and said second multi-stage vortex mixer are external to said combustion chamber.

14. A combustor of a turbine engine comprising:

a combustion chamber;

a first fuel injector;

a first multi-stage vortex mixer in direct communication with said combustor chamber at first multi-stage vortex mixer first and second pick-up points via first multi-stage vortex mixer first and second passages, said first multi-stage vortex mixer first and second passages extending from said first multi-stage vortex mixer first and second pick-up points, respectively, to said combustor, wherein said first multi-stage vortex mixer is downstream of said first fuel injector; and a second multi-stage vortex mixer in direct communication with said combustor chamber at second multi-stage vortex mixer first and second pick-up points via second multi-stage vortex mixer first and second passages, said second multi-stage vortex mixer first and second passages extending from said second multi-stage vortex mixer first and second pick-up points, respectively, to said combustor, wherein said second multi-stage vortex mixer is downstream of said first fuel injector, wherein said first multi-stage vortex mixer and said second multi-stage vortex mixer each comprise:

a first stage differential pressure amplifier for said combustion chamber;

a first stage first control passage in communication with said first stage differential pressure amplifier;

a first stage second control passage in communication with said first stage differential pressure amplifier, wherein said first stage first control passage and said first stage second control passage originate at said respective first and second pick-up points;

a first stage first outlet passage in communication with said first stage differential pressure amplifier;

a first stage second outlet passage in communication with said first stage differential pressure amplifier;

a feed passage in communication with said first stage amplifier, wherein said first stage differential pressure amplifier is configured to distribute flow from the feed passage to said first stage first and second outlet passages according to a differential pressure between said respective first and second pick-up points; and a vortex amplifier in communication with said first stage differential pressure amplifier, said vortex amplifier in communication with said combustor chamber through a dilution hole.

15. A method of cooling a combustor of a turbine engine comprising:

sensing combustor chamber pressure waves at two axially equivalent but circumferentially displaced pick-up points along a combustor chamber; and controlling a swirl of a dilution jet in response to the combustor chamber pressure waves with a first-stage differential pressure amplifier in direct communication with the pick-up points through first and second passages and a vortex amplifier in communication with the first-stage differential pressure amplifier and configured to provide a selective vortex swirl in the combustor chamber.

16. The method as recited in claim 15, further comprising sensing combustor chamber pressure waves upstream of the dilution jet.

17. The method as recited in claim 15, further comprising amplifying pressure pulses from the combustor chamber pressure waves.

18. The method as recited in claim 17, further comprising communicating the amplified pressure pulses to a vortex amplifier stage through a vortex amplifier stage first control passage and a vortex amplifier stage second control passage.

19. The method as recited in claim 18, further comprising communicating the amplified pressure pulses from the vortex amplifier stage first control passage and the vortex amplifier stage second control passage as tangentially directed control jets to mix with a main power supply jet.

20. The method as recited in claim 15, further comprising:

registering a pressure differential between said pick-up points; and directing jet flow to a vortex amplifier according to said pressure differential.

* * * * *